United States Patent [19]

Smoot

[11] 3,932,947

[45] Jan. 20, 1976

[54] BEARING AND SEAL FOR TUMBLER BELT CLOTHES DRYER

[75] Inventor: Edward H. Smoot, Holcomb, N.Y.

[73] Assignee: The Schlegel Manufacturing Company, Rochester, N.Y.

[22] Filed: Dec. 9, 1974

[21] Appl. No.: 531,159

[52] U.S. Cl. ..... 34/242; 34/133; 277/157; 277/235

[51] Int. Cl.[2] ..... F26B 25/00

[58] Field of Search ..... 34/132, 133, 134, 138, 34/139, 108, 242; 277/152, 157, 235, 227, 229; 432/115

[56] References Cited

UNITED STATES PATENTS

| | | | |
|---|---|---|---|
| 3,399,464 | 9/1968 | Erickson et al. | 34/133 |
| 3,584,393 | 6/1971 | Menk | 34/133 |
| 3,828,445 | 8/1974 | Smoot | 34/242 |
| 3,875,686 | 4/1975 | Smoot | 34/242 |

*Primary Examiner*—Kenneth W. Sprague
*Assistant Examiner*—James C. Yeung
*Attorney, Agent, or Firm*—George W. Shaw

[57] ABSTRACT

An improved bearing and seal is used in a clothes dryer having an endless belt for a tumbler with the belt being driven in matching channels formed in a pair of opposed upright panels. Carriers secured to the belt extend all around each edge of the belt and have a metallic element extending over the edge of the belt and disposed in the channel. Each of the carriers has a continuous pile strip disposed along the inside of the belt to engage inner edges of the channels to form a sealing barrier keeping lint and air from entering the channels, and each of the carriers has wear-resistant, low-friction material engaging the sides and bottoms of the channels to provide a running fit for the belt in the channels.

10 Claims, 4 Drawing Figures

BEARING AND SEAL FOR TUMBLER BELT CLOTHES DRYER

THE INVENTIVE IMPROVEMENT:

A clothes dryer can use an endless belt as a clothes tumbler instead of the usual rotating cylinder. The belt runs in a pair of matching channels in opposed upright panels and can follow a path that is non-circular for making better use of the space available within a generally rectangular dryer cabinet. Although an endless belt tumbler has many potential advantages, it presents difficult bearing and sealing problems in keeping lint and air inside the belt, and having a reasonably long wear life without requiring bearing replacement. Many circumstances have to be considered, including expansion and contraction with changes in temperature, reasonable manufacturing tolerances, total drag, wear life, sealing ability, and expense.

The invention involves recognition and analysis of all the circumstances and problems involved in providing a satisfactory bearing and seal for an endless belt tumbler for a clothes dryer, and the invention aims at solving all the problems with an economical, easy-to-install bearing and sealing strip that meets all the requirements for a clothes dryer and is able to last for the expected life of the clothes dryer.

SUMMARY OF THE INVENTION:

The inventive bearing and seal is applied to a clothes dryer having an endless tumbler belt driven in a pair of matching channels formed in a pair of opposed upright panels with the belt extending between the panels to provide a clothes drying chamber between the panels and inside the belt. A carrier extends all the way around each edge of the endless belt and is held securely on the belt. Each of the carriers has a metallic element extending over the edge of the belt and disposed in the channels, and each of the carriers has a continuous pile strip disposed along the inside of the belt to engage inner edges of the channel to form a sealing barrier keeping lint and air from entering the channels. Each of the carriers has a wear-resistant, low-friction material engaging the sides of the channels to provide a running fit for the belt in the channels, and each of the carriers has a wear-resistant, low-friction material arranged between the metallic element and the bottoms of the channels to provide edge bearings for the belt.

Figure 1:
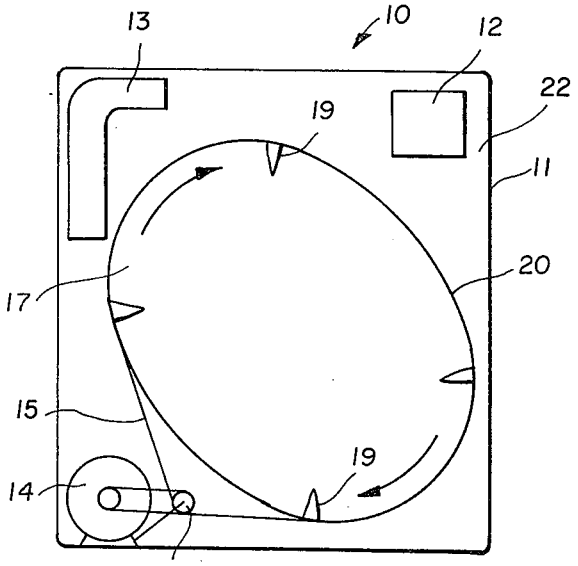
FIG. 1 is a partially schematic, elevational view of an endless tumbler belt clothes dryer having the front panel removed.

DETAILED DESCRIPTION:

FIG. 1 schematically shows a recent concept in clothes dryers for home use in which the inventive bearing and seal is applied. Dryer 10 has a generally rectangular cabinet 11, including schematically illustrated controls 12 and 13 and a motor 14 driving a belt 15 through a spring-loaded pulley 16. Instead of a clothes drying chamber formed within a rotating cylinder drum supported on bearings, clothes drying chamber 17 is formed inside an endless belt 20 driven round and round by drive belt 15. Endless belt 20 can follow a non-circular path such as an eliptical path shown in FIG. 1, and belt 20 has internal bars 19 that tumble the clothes as belt 20 moves.

Endless belt 20 has many advantages over prior art rotating drums, including its capacity to follow a non-circular path so as to make better use of the space available within rectangular cabinet 11. Also, belt 20 is relatively light in weight and economical to make so that the total cost of dryer 10 is less than a comparable dryer with a cylindrical drum, and at the same time, clothes drying chamber 17 is substantially larger so that dryer 10 can dry larger loads successfully.

Endless belt 20 is preferably formed of metallic material such as stainless steel, but can also be formed of plastic or other materials that can be made self supporting across the axial extent of clothes drying chamber 17 and can also withstand flexing in coursing around the path of travel for the life of dryer 10. The shape of the path travelled by belt 20 can also be varied to use the most possible space remaining within cabinet 11 after placement of controls 12 and 13 and motor 14. Bars 19 are formed of any convenient material and are securely fastened to belt 20.

Figure 3:
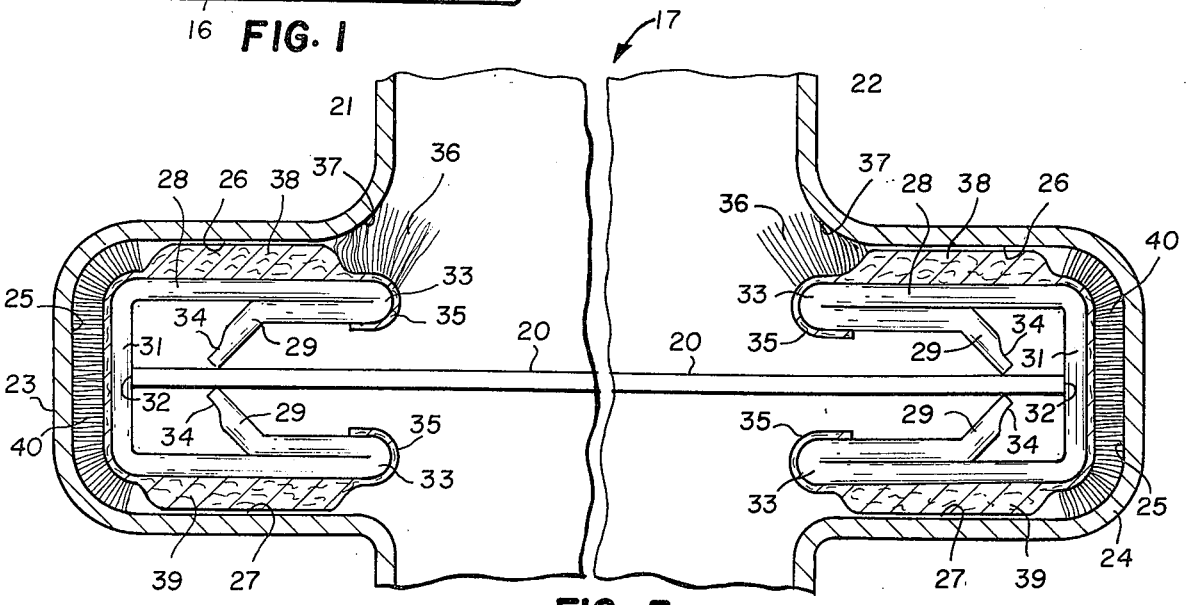
FIG. 3 is an enlarged, fragmentary cross-sectional view of a preferred embodiment of the inventive bearing and seal.
Figure 4:
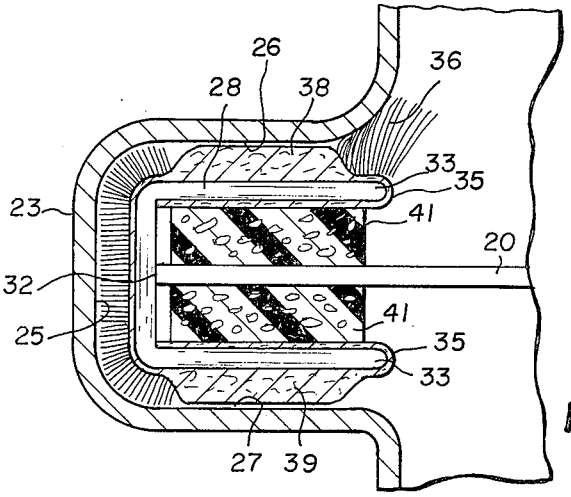
FIG. 4 is an enlarged, fragmentary, cross-sectional view of another preferred embodiment of the inventive bearing and seal.

As best shown in FIGS. 3 and 4, belt 20 travels in a pair of channels 23 and 24 formed respectively in front panel 21 and rear panel 22 to conform to the desired path of travel of belt 20. The invention involves a bearing and seal between the edges of belt 20 and channels 23 and 24 as described below.

Panels 21 and 22 are preferably formed of die-stamped sheet metal with channels 23 and 24 having bottoms 25, an inner side 26 and an outer side 27. Panel 21 along the front of dryer 10 includes a door opening (not shown) for loading and unloading the dryer, and panel 22 includes a moist-air exhaust (not shown) as generally known in the clothes dryer art. Clothes drying chamber 17 is the volume between panels 21 and 22 that is enclosed by belt 20 so that clothes can be tumbled dry.

Figure 2:
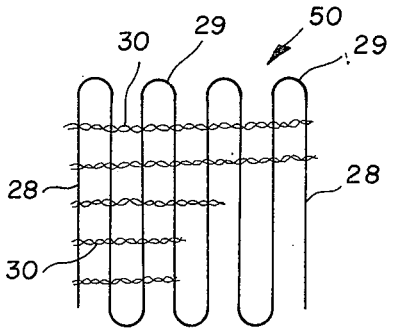
FIG. 2 is a partially schematic, plan view of a preferred embodiment of carrier for the inventive bearing and seal.

The inventive bearing and seal includes a carrier 50 supporting bearing and sealing materials and preferably formed of wire 28 laid in a zig-zag pattern as best shown in FIG. 2 with loops 29 secured together by stitching 30. The carrier 50 of FIG. 2 is generally known for other purposes, and its characteristics can be varied by changing the diameter and tensile strength of wire 28, the number of loops 29 per lineal measure, and the arrangement of stitching 30. In this invention, carrier 50 is fastened securely onto the edge surfaces of belt 20 and extends over the side edges 32 of belt 30 as shown in FIGS. 3 and 4. A carrier 50 for the inventive bearing and seal can also be formed of expanded or slit metallic or plastic elements flexible enough to follow along the path of travel of belt 20 and capable of being fastened securely over the edges of belt 20.

As shown in FIG. 3, carrier wire 28 is bent into a generally U shape with the bent portion 31 of the U shape extending over the edges 32 of belt 20 and with the straight sides 33 of the U shape extending along opposite face surfaces of belt 20 away from edge 32. The ends of loops 29 of carrier wire 28 are bent inward into the inside of the U shape and preferably have flattened or coined ends 34 bent inward toward belt 20 to engage and bite against opposite surfaces of belt 20 to hold carrier wire 28 securely on belt 20.

Carrier wire 28 is preferably covered with a woven fabric material 35 secured in place by adhesive or stitching or both around the outside of the U shape formed by carrier 50. Fabric cover 35 supports a strip of pile material 36 disposed along the inside of belt 20 to engage the inner edge 37 of channels 23 and 24. Pile strip 36 is preferably formed of relatively fine, monofilament resin material such as nylon and is made relatively dense to keep air and lint from passing from chamber 17 into channels 23 or 24. The filaments of pile strips 36 brush lightly against the inner edges 37 of the channels to provide low friction and low drag, and in addition to sealing against air and lint, pile strips 36 keep clothing or other articles in chamber 17 from working their way in between belt 20 and channels 23 and 24.

Fabric cover 35 also carries a pair of bearing elements 38 and 39 respectively engaging inside wall 26 and outside wall 27 of channels 23 and 24 to provide a running fit for belt 20 in channels 23 and 24. Bearing elements 38 and 39 can be formed of various materials including low-friction resin materials, either in solid strip form, or in woven fabric form, and the choice of materials for bearing elements 38 and 39 depends on the shape of the path of belt 20 and the stresses occurring between belt 20 and channels 23 and 24, the wear life to be achieved, and the cost of the materials involved. With proper design of other parameters, bearing elements 38 and 39 can be formed of a woven fabric resin material such as nylon and for lower friction and drag, a strip of tough, wear-resistant, low-friction resin material such as polytetraflouroethylene can be applied to the outer faces of bearing elements 38 and 39.

Loop portions 31 of wire carrier 28 extend over edges 32 of belt 20 to keep edges 32 from cutting into a bearing element. Loops 31 effectively widen the edge of belt 20 to distribute the edge load over a greater area, and fabric 35 carries a bearing material between wire portions 31 and the bottom 25 of channels 23 and 24. As shown in FIG. 3, this bearing material is preferably a row of pile material 40 brushing with relatively low friction against channel bottoms 25 to provide edge bearings for belt 20. Pile 40 is preferably formed of resin fiber material such as nylon and having a length, density, and resilience to wear satisfactorily against channel bottoms 25 for the life of the dryer and still provide relatively low friction and drag for belt 20.

The inventive bearings and seals are secured tightly all around the edges of belt 20 which is then placed into channels 23 and 24 as panels 21 and 22 are assembled into dryer 10. At least the end splices in the bearing and seal elements are preferably secured in place with adhesive.

The embodiment of FIG. 4 is similar to the embodiment of FIG. 3, except that more clearance exists between edge bearing pile 40 and channel bottoms 25, and carrier wire 28 is secured on belt 20 by a pair of double-faced adhesive strips 41, rather than inturned loops of wire. There are other ways that carriers can be secured to the edges of the belt 20, and the best method of fastening a carrier in place depends on the construction of the carrier itself. Adhesive strips 41 can be used for many kinds of carriers formed of flexible metallic or plastic strips. Any such carrier preferably disposes a metallic element over the edges 32 of belt 20 and is fastened securely to belt 20 to travel along with belt 20 and move relative to channels 23 and 24. Also, pile strips and sealing elements on the carriers must be arranged to have satisfactory bearing surfaces and low enough friction so that belt 20 can be driven with a low-powered motor and so the bearing and sealing strips will last for the life of the dryer. The metallic element over edges 32 prevent edges 32 from cutting through the bearing, and the lack of motion of the bearing relative to belt 20 also reduces the cutting effect of edges 32.

Those skilled in the art will appreciate the many materials, configurations, and ways of assembling various bearing and sealing strips on an endless belt dryer tumbler to meet the particular circumstances of any given design. Once the concepts of the invention are applied with generally known technology, the results are quite satisfactory, and endless belt dryers provided with the inventive seals and bearings have many advantages over prior art cylindrical drum dryers.

I claim:

1. In a clothes dryer having an endless tumbler belt driven in a pair of matching channels formed in a pair of opposed upright panels with said belt extending between said panels to provide a clothes drying chamber between said panels and inside said belt, a bearing and seal comprising:

a. a carrier extending all the way around each edge of said endless belt;

b. means for holding each of said carriers securely on said belt;

c. each of said carriers having a metallic element extending over said edge of said belt and disposed in said channels;

d. each of said carriers having a continuous pile strip disposed along the inside of said belt to engage inner edges of said channels to form a sealing barrier keeping lint and air from entering said channels;

e. each of said carriers having a wear-resistant, low-friction material engaging the sides of said channels to provide a running fit for said belt in said channels; and f. each of said carriers having a wear-resistant, low-friction material arranged between said metallic element and the bottoms of said channels to provide edge bearings for said belt.

2. The bearing and seal of claim 1 wherein said carriers are generally U shaped in cross section with the free ends of said U shape fitted over opposite surfaces of said edge of said belt.

3. The bearing and seal of claim 1 wherein said carriers are formed of zig-zag wire covered with woven fibrous material.

4. The bearing and seal of claim 3 wherein said carriers are generally U shaped in cross section with the free ends of said U shape fitted over opposite surfaces of said edge of said belt.

5. The bearing and seal of claim 4 wherein end loops of said zig-zag wire are bent inward from said free ends of said U shape to provide said means for holding said carrier on said belt.

6. The bearing and seal of claim 5 wherein said end loops of said zig-zag wire are coined for gripping said belt.

7. The bearing and seal of claim 1 wherein said wear material engaging said sides of said channels is formed of woven fibrous material.

8. The bearing and seal of claim 1 wherein said wear material engaging said bottoms of said channels is formed of pile material.

9. The bearing and seal of claim 8 wherein said wear material engaging said sides of said channels is formed of woven fibrous pile material.

10. The bearing and seal of claim 1 wherein said means for holding said carriers on said belt includes adhesive.

* * * * *